US011833099B2

(12) United States Patent
Zhong

(10) Patent No.: US 11,833,099 B2
(45) Date of Patent: Dec. 5, 2023

(54) MULTIFUNCTIONAL SEX TOY

(71) Applicant: ODECO LIMITED, Shenzhen (CN)

(72) Inventor: Huiming Zhong, Shenzhen (CN)

(73) Assignee: ODECO LIMITED, Shenzhen (CN)

( * ) Notice: Subject to any disclaimer, the term of this patent is extended or adjusted under 35 U.S.C. 154(b) by 947 days.

(21) Appl. No.: 16/643,914

(22) PCT Filed: Feb. 27, 2019

(86) PCT No.: PCT/CN2019/076273
§ 371 (c)(1),
(2) Date: Mar. 3, 2020

(87) PCT Pub. No.: WO2020/172808
PCT Pub. Date: Sep. 3, 2020

(65) Prior Publication Data

US 2023/0149253 A1 May 18, 2023

(30) Foreign Application Priority Data

Feb. 26, 2019 (CN) ..... 201920242702.9

(51) Int. Cl.
*A61H 19/00* (2006.01)

(52) U.S. Cl.
CPC ..... *A61H 19/32* (2013.01); *A61H 19/40* (2013.01); *A61H 2201/0192* (2013.01)

(58) Field of Classification Search
CPC ..... A61H 19/32; A61H 19/40; A61H 2201/0192; A61H 19/00
See application file for complete search history.

(56) References Cited

U.S. PATENT DOCUMENTS

2012/0316390 A1* 12/2012 Topolev ..... A61H 19/30 600/38
2016/0051438 A1* 2/2016 Hahr ..... A61H 19/34 601/72

FOREIGN PATENT DOCUMENTS

CN 107260519 A * 10/2017
DE 202014010727 U1 * 7/2016 ..... A61H 19/44

OTHER PUBLICATIONS

Satisfyer Endless Love Couple's Vibrator accessed online at www.amazon.com/Satisfyer-Partner-Multi-Fun-Blue/dp/B07GWTFZ82 on May 24, 2023, first date available on or after Oct. 3, 2018. (Year: 2018).*

(Continued)

*Primary Examiner* — Kaylee R Wilson
(74) *Attorney, Agent, or Firm* — McClure, Qualey & Rodack, LLP

(57) ABSTRACT

A multifunctional sex toy includes a housing, wherein the housing comprises an upper plastic housing and a lower plastic housing, a chamber is formed between the upper plastic housing and the lower plastic housing. A first PCBA and a third motor are installed inside the chamber, and an arc-shaped recess is arranged on the side edge of the housing. A first bendable shaping pipe and a second bendable shaping pipe are installed at the right end of the housing, the right end of the first bendable shaping pipe is provided with a first plastic motor sleeve inside which a first motor is installed, and the right end of the second bendable shaping pipe is provided with a second plastic motor sleeve inside which a second motor is installed.

13 Claims, 4 Drawing Sheets

(56) References Cited

OTHER PUBLICATIONS

Adorime G-spot Rabbit Vibrator accessed online at www.amazon.com/Adorime-Vibrating-Vibration-Rechargeable-Stimulator/dp/B07DQGN3S8 on May 24, 2023, first date available on or after Jun. 13, 2018 (Year: 2018).*

* cited by examiner

MULTIFUNCTIONAL SEX TOY

TECHNICAL FIELD

The present invention relates to the technical field of the sex toy, in particular to a multifunctional sex toy.

BACKGROUND TECHNOLOGY

With the improvement of the level of human living standard, in addition to material aspects, more spiritual needs are being pursued. Sexual life of husband and wife has become more and more important as a spice of family life, thereby requiring varied products to add different pleasures to sexual life of husband and wife.

At present, functions of the sex toys shared by couples are relatively simple. For example, the sperm locking ring could only be sleeved onto the root of male penis to massage the external part of the female vagina, but fail to massage the male penis at the same time. Meanwhile, the size of ring sleeved onto the root of male penis is fixed, the situation of over-tightening or over-loosening will be caused due to different size of the male penis, for instance, the massager capable of massaging the external and reaching into the female vagina at the same time however could not be worn on the male penis and could not be used to massage the penis of a male because of fixed shape, for example, due to fixed angles of some massagers' heads, the massagers could not adjust the angles of the massagers' head according to different positions of the female vagina to be well attached to the external of the female vagina, or even possibly cause some consumers pain.

SUMMARY OF THE INVENTION

The object of the present invention is to provide a multifunctional sex toy and solve issues raised in the above background.

To realize above object, the present invention adopts the following technical schemes:

A multifunctional sex toy comprising a housing, wherein the housing comprises a lower plastic housing and an upper plastic housing, a chamber is formed between the upper plastic housing and the lower plastic housing, a battery is installed inside the chamber, on the battery installs a second PCBA, the second PCBA is provided with a first charging nail and a second charging nail through a first eyelet and a second eyelet, inside the chamber further installs a first PCBA, the first PCBA is provided with a first light-guiding pillar and a second light-guiding pillar, and the upper ends of the first light-guiding pillar and the second light-guiding pillar extend out of the upper plastic housing and are provided with a first keycap and a second keycap; wherein inside the housing installs a third motor, on the side edge of the housing arranges an arc-shaped recess, at the positions where the front side and the rear side of the arc-shaped recess on the right end of the housing are located, a first bendable shaping pipe and a second bendable shaping pipe are installed respectively through a first plastic retainer ring and a second plastic retainer ring, the right end of the first bendable shaping pipe is provided with a first plastic motor sleeve inside which a first motor is arranged, and on the right end of the second bendable shaping pipe is provided with a second plastic motor sleeve inside which a second motor is arranged.

As a further scheme of present invention, an integrally formed flexible sleeve is wrapped on the outside of the housing, the first bendable shaping pipe, the second bendable shaping pipe, the first plastic motor sleeve and the second motor.

As a further scheme of present invention, the first motor, the second motor and the third motor are all multi-frequency vibration motors.

As a further scheme of present invention, the first motor and the second motor are electrically connected with the first PCBA through the electric wire built in the first bendable shaping pipe and the second bendable shaping pipe, and the third motor is electrically connected with the first PCBA through the electric wire.

As a further scheme of present invention, at the bottom of flexible sleeve outside the housing is provided with ripple-shaped massage lines.

As a further scheme of present invention, the flexible sleeve outside the first plastic motor sleeve and the second plastic motor sleeve is provided with streamlined convex lines.

As a further scheme of present invention, the first bendable shaping pipe and the second bendable shaping pipe are equal in length, and the first bendable shaping pipe and the second bendable shaping pipe are metal hoses or plastic pipes.

As a further scheme of present invention, there is a certain angle between first bendable shaping pipe and the first plastic motor sleeve, there is a certain angle between the second bendable shaping pipe and the second plastic motor sleeve, and the angles are greater than 90 degrees.

As a further scheme of present invention, there is a certain angle between the side of the housing where the arc-shaped recess is located on and the primary flat of the housing, and the angle is more than 90 degrees.

As a further scheme of present invention, the flexible sleeve is made of silica-gel material.

Compared with the prior art, beneficial effect of the present invention is that the device could form different shapes and angles to provide various massage methods for consumers through the first bendable shaping pipe and the second bendable shaping pipe, both of which could be bent at fixed angles:

1. The invention could be suitable for different sizes of the male penis. The arrangement of arc-shaped recess could fit the male penis better. The arrangement of the first bendable shaping pipe and the second bendable shaping pipe that could be bent at fixed angles, could be suitable for different sizes of the male penis. And with stronger wrapping property, it will not be too tight or too loose;
2. The two massager's heads are connected at a fixed angle, therefore more suitable angles could be adjusted according to the different positions of female sexual organs to closely massage female parts when massaging the external part of the female vagina, and the massage effect could be better;
3. The arrangement of bending at an angle enables the first bendable shaping pipe and the second bendable shaping pipe to be straightened as a single massage rod to extend into the female vagina, and enables the lifting angle of the massager's head to be adjusted to an ergonomic angle so that the massager's head directly reaches the position of a G point inside the female vagina, which brings more effective stimulation to female consumers;

4. The two massager's heads could form a clamp-like shape by adjusting angles and are used to shake and clamp different parts of the female, such as the breasts, clitoris and so on;
5. The two massager's heads are adjusted to simulate the shape of finger digging by adjusting the angle, and are used for providing dig action to the external parts of the female and giving different feelings to consumers;
6. The present sex toy could be folded inwards into a large C shape, and the two massager's heads extend into the female vagina, and the main body massages the external of the female vagina. The external and the internal of the female vagina and the male penis could be massaged at the same time, which could bring better experience to sexual life of husband and wife.

Figure 1:
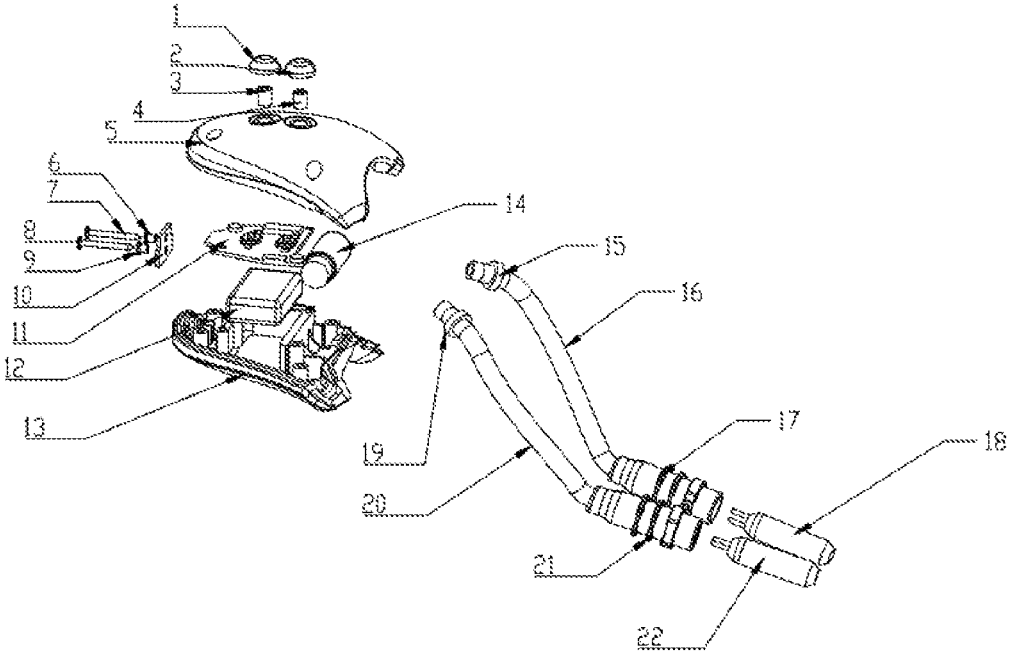
FIG. 1 is a structural diagram of the device.

The markup in the text are listed as follows:

1-first keycap; 2-second keycap; 3-first light-guiding pillar; 4-second light-guiding pillar; S-upper plastic housing; 6-first eyelet; 7-first charging nail; 8-second charging nail; 9-second eyelet; 10-second PCBA; 11-first PCBA; 12-battery; 13-lower plastic housing; 14-third motor; 15-first plastic retainer ring; 16-first bendable shaping pipe; 17-first plastic motor sleeve; 18-first motor; 19-second plastic retainer ring; 20-second bendable shaping pipe; 21-second plastic motor sleeve; 22-second motor.

DETAILED DESCRIPTION

It should be noted that, in the case of no conflict, the embodiments in the present invention and the features in the embodiments may be combined with each other.

In the description of the present invention, it should be understood that the terms "middle", "longitudinal", "transversely", "up", "down", "front", "rear", "left", "right", "vertical", "horizontal", "top", "bottom", "inside", "outside" and the like are based on the orientation or positional relationship shown in the drawings, and are merely intended to facilitate the description of the invention and to simplify the description, rather than indicating or implying that the device or element referred to have a specific orientation or must be constructed and operated in a particular orientation, therefore, the terms are not to be construed as limiting the invention. Moreover, the terms "first", "second", and the like are used for the purpose of description only, and are not to be construed as indicating or implying a relative importance or implicitly indicating the number of technical features indicated. Thus, features defining "first", "second" and the like may include one or more of the features either explicitly or implicitly. In the description of the present invention, "plurality" means two or more unless otherwise stated.

In the description of the present invention, it should be noted that the terms "provide" and "connect" should be understood broadly, unless explicitly stated and limited. For example, it may be a fixed connection, a detachable connection, or an integral connection; it may be a mechanical connection or an electrical connection; it may be directly connected, or may be indirectly connected through an intermediate medium, and may be an internal connection between two components. And the specific meaning of the above terms in the present invention could be understood by those of ordinary skill in the art through specific circumstances.

The invention will be described in detail below with reference to the drawings in conjunction with the embodiments.

Embodiment 1

Figure 2:
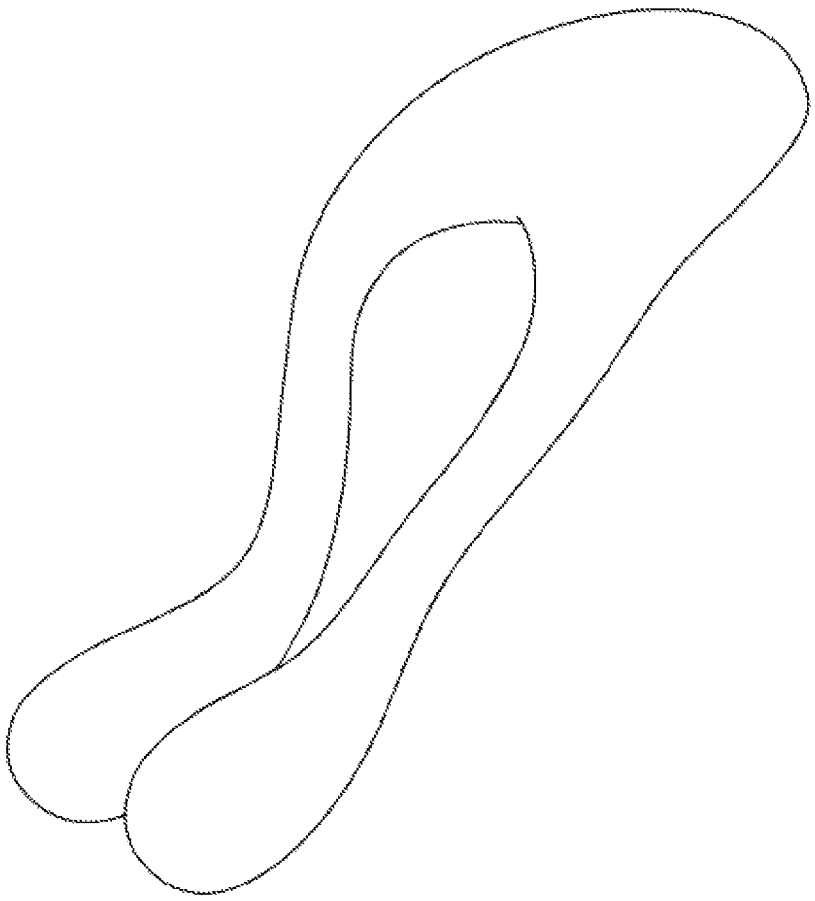
FIG. 2 is a first perspective view of the device.
Figure 3:
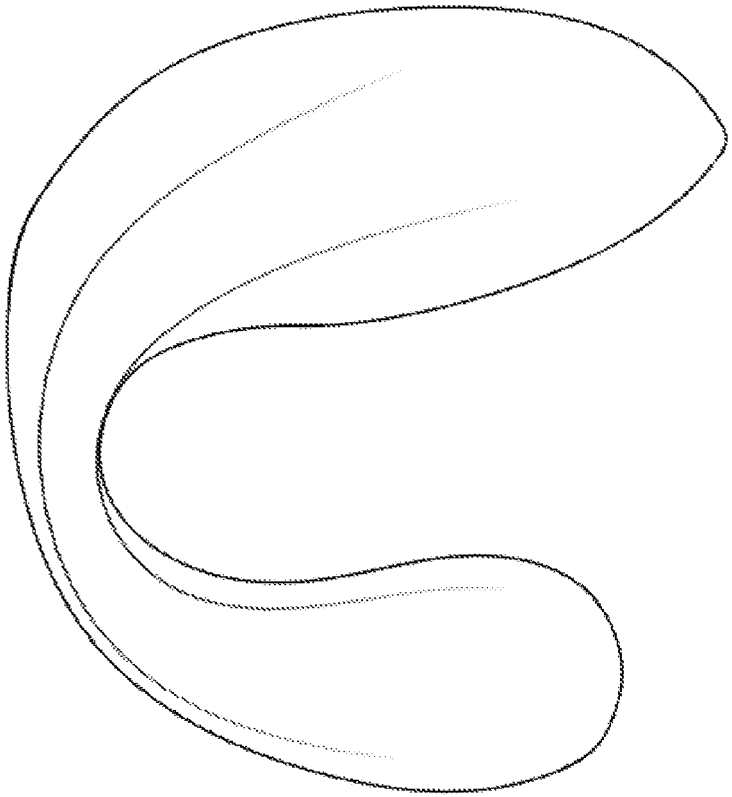
FIG. 3 is a second perspective view of the device.
Figure 4:
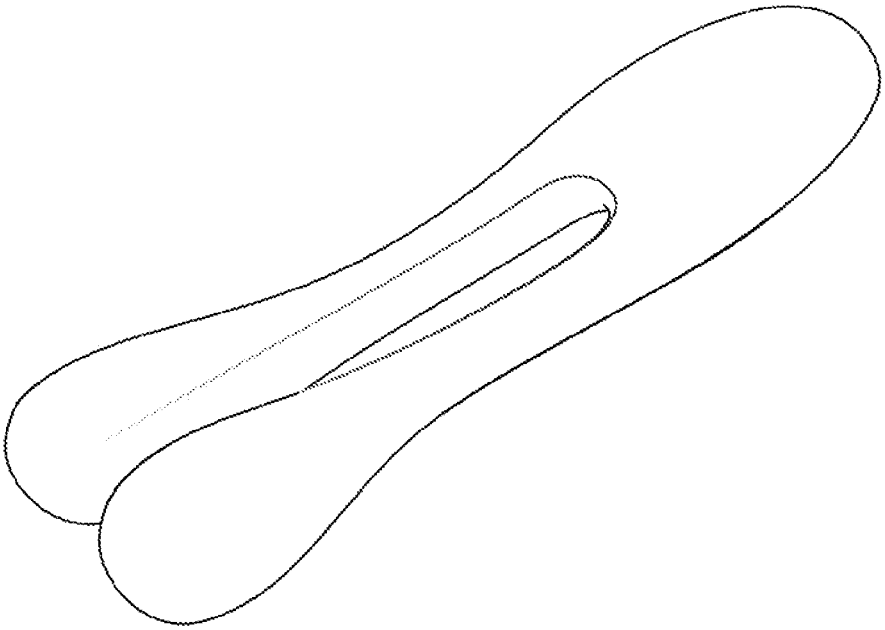
FIG. 4 is a third perspective view of the device.

As shown in FIG. 1 to FIG. 4, a multifunctional sex toy of an embodiment in the present invention comprising the housing, wherein the housing comprises a lower plastic housing 13 and an upper plastic housing 5, a chamber is formed between the upper plastic housing 13 and the upper plastic housing 5, and a battery 12 is installed inside the chamber, on the battery 12 installs a second PCBA 10, the second PCBA 10 is provided with a first charging nail 7 and a second charging nail 8 through a first eyelet 6 and a second eyelet 9, inside the chamber further installs a first PCBA 11, the first PCBA 11 is provided with a first light-guiding pillar 3 and a second light-guiding pillar 4, and the upper ends of the first light-guiding pillar 3 and the second light-guiding pillar 4 extend out of the upper plastic housing 5 and are provided with a first keycap 1 and a second keycap 2, wherein inside the housing installs a third motor 14, and on the side edge of the housing arranges an arc-shaped recess, at the positions where the front side and the rear side of the arc-shaped recess on the right end of the housing are located, a first bendable shaping pipe 16 and a second bendable shaping pipe 20 are installed respectively through a first plastic retainer ring 15 and a second plastic retainer ring 19, the right end of the first bendable shaping pipe 16 is provided with a first plastic motor sleeve 17 inside which a first motor 18 is arranged, and on the right end of the second bendable shaping pipe 20 is provided with a second plastic sleeve 21 for motor inside which a second motor 22 is arranged.

An integrally formed flexible sleeve is wrapped on the outside of the housing, the first bendable shaping pipe 16, the second bendable shaping pipe 20, the first plastic motor sleeve 17 and the second plastic motor sleeve 21, which improves the comfort of use and the aesthetics.

The first motor 18, the second motor 22 and the third motor 14 are all multi-frequency vibration motors to meet the requirements of using different frequency bands.

The first motor 18 and the second motor 22 are electrically connected with the first PCBA 11 through the electric wire built in the first bendable shaping pipe 16 and the second bendable shaping pipe 20 and the third motor 14 is electrically connected with the first PCBA 11 through the electric wire. The first bendable shaping pipe 16 and the second bendable shaping pipe 20 are equal in length, and the first bendable shaping pipe 16 and the second bendable shaping pipe 20 are metal hoses or plastic pipes.

There is a certain angle between first bendable shaping pipe 16 and the first plastic motor sleeve 17, and there is a certain angle between the second bendable shaping pipe 20 and the second plastic motor sleeve 21, and the angles are greater than 90 degrees. There is a certain angle between the side of the housing where the arc-shaped recess is located on and the primary flat of the housing, and the angle is more than 90 degrees. The flexible sleeve is made of silica-gel material.

The device could form different shapes and angles to provide various massage methods for consumers through the first bendable shaping pipe and the second bendable shaping pipe, both of which could be bent at fixed angles.

1. The invention could be suitable for different sizes of the male penis. The arrangement of arc-shaped recess could fit the male penis better. The arrangement of the first bendable shaping pipe and the second bendable shaping pipe that could be bent at fixed angles, could be suitable for different sizes of the male penis, and with stronger wrapping property, it will not be too tight or too loose;

2. The two massager's heads are connected at a fixed angle, therefore more suitable angles could be adjusted according to the different positions of female sexual organs to closely massage female parts when massaging the external part of the female vagina and that the massage effect could be better;

3. The arrangement of bending at an angle enables the first bendable shaping pipe and the second bendable shaping pipe to be straightened as a single massage rod to extend into the female vagina, and enables the lifting angle of the massager's head to be adjusted to an ergonomic angle so that the massager's head directly reaches the position of a G point inside the female vagina, which brings more effective stimulation to female consumers;

4. The two massager's heads could form a clamp-like shape by adjusting angles and are used to shake and clamp different parts of the female, such as the breasts, clitoris and so on;

5. The two massager's heads are adjusted to simulate the shape of finger digging by adjusting the angle, and are used for providing dig action to the external parts of the female and giving different feelings to consumers;

6. The present sex toy could be folded inwards into a large C shape, and the two massager's heads extend into the female vagina, and the main body massages the external of the female vagina. The external and the internal of the female vagina and the male penis could be massaged at the same time, which could bring better experience to sexual life of man and wife.

Embodiment 2

On the basis of the embodiment 1, the bottom of flexible sleeve outside the housing is provided with rippled-shape massage line and the flexible sleeve outside the first plastic motor sleeve and the second plastic motor sleeve is provided with streamlined convex lines, which further improves the comfort of use.

The above-mentioned embodiments are merely preferred embodiments of the present invention, and are not intended to limit the present invention. Any modifications, equivalents, improvements, etc. made within the spirit and scopes of the present invention are intended to be included within the protection scope of the present invention.

The invention claimed is:

1. A multifunctional sex toy comprising a housing, wherein the housing comprises a lower plastic housing 13 and an upper plastic housing 5, a chamber is formed between the lower plastic housing 13 and the upper plastic housing 5, a battery 12 is installed inside the chamber, on the battery 12 installs a first printed circuit board assembly (PCBA) 10, the first PCBA 10 is provided with a first charging nail 7 and a second charging nail 8 through a first eyelet 6 and a second eyelet 9, inside the chamber further installs a second PCBA 11, the second PCBA 11 is provided with a first light-guiding pillar 3 and a second light-guiding pillar 4, and upper ends of the first light-guiding pillar 3 and the second light-guiding pillar 4 extend out of the upper plastic housing 5 and are provided with a first keycap 1 and a second keycap 2, respectively; wherein inside the housing installs a first motor 14, on a side edge of the housing arranges an arc-shaped recess, at positions where a front side and a rear side of the arc-shaped recess on a right end of the housing are located, a first bendable shaping pipe 16 and a second bendable shaping pipe 20 are installed respectively through a first plastic retainer ring 15 and a second plastic retainer ring 19, a right end of the first bendable shaping pipe 16 is provided with a first plastic motor sleeve inside which a second motor 18 is arranged and a right end of the second bendable shaping pipe 20 is provided with a second plastic motor sleeve 21 for motor inside which a third motor 22 is arranged.

2. The multifunctional sex toy according to claim 1, wherein an integrally formed flexible sleeve is wrapped on an outside of the housing, the first bendable shaping pipe 16, the second bendable shaping pipe 20, the first plastic motor sleeve 17 and the second plastic motor sleeve 21.

3. The multifunctional sex toy according to claim 2, wherein a bottom portion of flexible sleeve wrapped on the outside of the housing is provided with ripple-shaped massage lines.

4. The multifunctional sex toy according to claim 3, wherein the flexible sleeve is made of silica-gel material.

5. The multifunctional sex toy according to the claim 2, wherein the flexible sleeve outside the first plastic motor sleeve 17 and the second plastic motor sleeve 21 is provided with streamlined convex lines.

6. The multifunctional sex toy according to claim 5, wherein the flexible sleeve is made of silica-gel material.

7. The multifunctional sex toy according to claim 2, wherein the flexible sleeve is made of silica-gel material.

8. The multifunctional sex toy according to claim 2, wherein the second motor 18, the third motor 22 and the first motor 14 are all multi-frequency vibration motors.

9. The multifunctional sex toy according to claim 1, wherein the second motor 18, the third motor 22 and the first motor 14 are all multi-frequency vibration motors.

10. The multifunctional sex toy according to claim 9, wherein the second motor 18 and the third motor 22 are electrically connected with the second PCBA 11 through at least one electric wire built in the first bendable shaping pipe 16 and the second bendable shaping pipe 20, and the first motor 14 is electrically connected with the second PCBA 11 through the at least one electric wire.

11. The multifunctional sex toy according to claim 1, wherein the first bendable shaping pipe 16 and the second bendable shaping pipe 20 are equal in length, and the first bendable shaping pipe 16 and the second bendable shaping pipe 20 are metal hoses or plastic pipes.

12. The multifunctional sex toy according to claim 1, wherein there is a first angle between first bendable shaping pipe 16 and the first plastic motor sleeve 17, there is a second angle between the second bendable shaping pipe 20 and the second plastic motor sleeve 21, and the first angle and the second angle are greater than 90 degrees.

13. The multifunctional sex toy according to claim 1, wherein there is an angle between a side of the housing where the arc-shaped recess is located on and a primary flat plane of the housing, and the angle is more than 90 degrees.

* * * * *